US010772405B2

(12) United States Patent
Nash

(10) Patent No.: US 10,772,405 B2
(45) Date of Patent: Sep. 15, 2020

(54) INSULATED SOFT-BODY COOLER

(71) Applicant: Edwin Strudwick Nash, Alpharetta, GA (US)

(72) Inventor: Edwin Strudwick Nash, Alpharetta, GA (US)

( * ) Notice: Subject to any disclaimer, the term of this patent is extended or adjusted under 35 U.S.C. 154(b) by 0 days.

(21) Appl. No.: 16/588,649

(22) Filed: Sep. 30, 2019

(65) Prior Publication Data

US 2020/0029666 A1 Jan. 30, 2020

Related U.S. Application Data

(63) Continuation of application No. 15/851,328, filed on Dec. 21, 2017, now Pat. No. 10,426,241, which is a continuation of application No. 15/051,606, filed on Feb. 23, 2016, now Pat. No. 9,901,153.

(60) Provisional application No. 62/119,451, filed on Feb. 23, 2015.

(51) Int. Cl.

| | |
|---|---|
| ***A45C 13/30*** | (2006.01) |
| ***A45F 3/00*** | (2006.01) |
| ***A45F 3/04*** | (2006.01) |
| ***A45F 3/46*** | (2006.01) |
| ***A45C 11/20*** | (2006.01) |
| ***A45C 13/10*** | (2006.01) |
| ***B65D 81/38*** | (2006.01) |

(52) U.S. Cl.

CPC ..... *A45C 13/30* (2013.01); *A45C 11/20* (2013.01); *A45C 13/103* (2013.01); *A45F 3/04* (2013.01); *A45F 3/46* (2013.01); *B65D 81/3858* (2013.01); *A45F 2003/003* (2013.01)

(58) Field of Classification Search

CPC . B65D 81/3858; B65D 81/3862; A45C 11/20; A45F 3/46

See application file for complete search history.

(56) References Cited

U.S. PATENT DOCUMENTS

| | | | | | |
|---|---|---|---|---|---|
| 1,934,360 | A | * | 11/1933 | Laufman | A45C 3/00 190/114 |
| 1,962,594 | A | * | 6/1934 | Herrmann | A45C 13/103 190/114 |
| 2,144,266 | A | * | 1/1939 | Nathan | A45C 3/00 190/114 |
| 3,963,102 | A | * | 6/1976 | Carp | A45C 3/00 190/108 |
| 4,210,186 | A | * | 7/1980 | Belenson | A45C 3/00 190/110 |
| 4,509,645 | A | | 4/1985 | Hotta | |
| 4,706,856 | A | | 11/1987 | Jacober | |
| 4,765,476 | A | | 8/1988 | Lee | |
| 4,819,793 | A | | 4/1989 | Willard et al. | |
| 5,005,679 | A | * | 4/1991 | Hjelle | A45C 3/00 150/106 |

(Continued)

*Primary Examiner* — Brian D Nash

(74) *Attorney, Agent, or Firm* — Troutman Pepper Hamilton Sanders LLP; Christopher C. Close, Jr.; Nicholas Doss

(57) ABSTRACT

Aspects of the present disclosure relate to an insulated, waterproof, soft-side cooler. The soft-side cooler may comprise an insulated core formed form a single piece of foam. Further, the soft-side cooler may comprise a zipper configuration that allows for zipping down the middle of the top of the soft-side cooler, thus allowing for the full, six-sided insulation while also allowing for wide-mouth opening that allows users easy access into the insulated compartment.

19 Claims, 15 Drawing Sheets

(56) References Cited

U.S. PATENT DOCUMENTS

| | | | | |
|---|---|---|---|---|
| 5,501,338 | A | 3/1996 | Preston | |
| 5,509,279 | A | 4/1996 | Brown et al. | |
| 5,562,228 | A | 10/1996 | Ericson | |
| 5,745,960 | A * | 5/1998 | Dishner | A44B 19/00 24/381 |
| 5,758,513 | A | 6/1998 | Smith | |
| 5,857,778 | A | 1/1999 | Ells | |
| 6,027,249 | A | 2/2000 | Bielinski | |
| 6,065,873 | A | 5/2000 | Fowler | |
| 6,067,813 | A | 5/2000 | Smith | |
| 6,092,574 | A * | 7/2000 | Krulik | A45C 13/30 150/110 |
| 6,116,045 | A | 9/2000 | Hodosh et al. | |
| 6,237,776 | B1 * | 5/2001 | Mogil | A45C 3/00 150/106 |
| 6,247,328 | B1 | 6/2001 | Mogil | |
| 6,357,497 | B1 * | 3/2002 | Frase | A45C 3/00 150/109 |
| 6,409,066 | B1 | 6/2002 | Schneider et al. | |
| 7,011,224 | B2 | 3/2006 | Sheng-Bin | |
| 7,162,890 | B2 | 1/2007 | Mogil et al. | |
| 7,240,513 | B1 | 7/2007 | Conforti | |
| 7,313,927 | B2 | 1/2008 | Barker | |
| 7,730,739 | B2 | 6/2010 | Fuchs | |
| 8,640,937 | B2 | 2/2014 | Pruchnicki | |
| 9,139,352 | B2 | 9/2015 | Seiders et al. | |
| 9,422,099 | B2 | 8/2016 | Mitchell et al. | |
| 2002/0126920 | A1 * | 9/2002 | Mogil | A45C 7/0077 383/110 |
| 2004/0035143 | A1 | 2/2004 | Mogil | |
| 2008/0245096 | A1 | 10/2008 | Hanson et al. | |
| 2011/0259894 | A1 | 10/2011 | Cheung | |
| 2016/0101924 | A1 | 4/2016 | Mitchell et al. | |

* cited by examiner

INSULATED SOFT-BODY COOLER

CROSS-REFERENCE TO RELATED APPLICATIONS

This Application is a continuation of U.S. Non-Provisional patent application Ser. No. 15/851,328, filed Dec. 21, 2017, which is a continuation of U.S. Non-Provisional patent application Ser. No. 15/051,606, filed Feb. 23, 2016, which claims priority to and benefit under 35 U.S.C. § 119(e) of U.S. Provisional Patent Application Ser. No. 62/119,451 filed Feb. 23, 2015, all of which are incorporated by reference herein in their entirety as if it fully set forth below.

FIELD OF THE INVENTION

The presently disclosed subject matter relates generally to insulated coolers and methods of manufacturing the same and, more particularly, to insulated, waterproof soft cooler bags utilizing closed-cell foam on all sides and having a flexible zipper mechanism along the middle of the top surface of the cooler bag.

BACKGROUND

Coolers are commonly used to keep food and drinks cool on picnics, camping trips, beach trips, and other excursions where conventional refrigeration is not a feasible option. Traditional coolers (i.e., "ice chests") were box-shaped and had a galvanized exterior. Over time, coolers came to have hard plastic exteriors. But hard-body coolers are often inconvenient because their fixed shape can make them difficult to stow or transport. Further, such hard-body coolers can be difficult for an individual to carry. As a result, soft-body coolers became a popular alternative. But while soft-body coolers can be easier to stow or transport, they often fail to provide the same performance as a hard-body cooler. In particular, soft-body coolers have a tendency to leak and sweat, and they are generally incapable of providing the same temperature-maintaining functionality as a hard-body cooler. And often, soft-body coolers lack insulation on the top of the cooler, therefore severely decreasing the cooler's temperature maintenance properties. Further, soft-body coolers have inadequate zipper mechanisms that tend to pull away or tear out easily from the body of the soft-body cooler. Moreover, these zipper mechanisms are assembled in such a way as to have holes that decrease the cooler's insulating capabilities.

Accordingly, there is a need for improved soft-body coolers to address the above-mentioned deficiencies. Embodiments of the present disclosure are directed to these and other considerations.

SUMMARY

Briefly described, embodiments of the presently disclosed subject matter relate to insulated, waterproof, soft-body (i.e., soft-side) coolers and methods of manufacturing the same. The soft-side cooler may comprise an outer shell, an inner liner, an insulating core, and a zipper mechanism or zipper configuration. The insulating core can be disposed between the outer shell and the inner liner and (have opposing first and second vertical walls. The opposing first and second vertical walls can each comprise an upper portion and a lower portion. Additionally, the insulating core can be disposed between and affixed to at least one of the outer shell and the inner liner). In some embodiments, the insulating core can comprise a single piece of closed-cell foam that, in some embodiments. In some embodiments, the single piece of closed-cell foam can comprise contouring that permits the single piece of closed-cell foam to be folded and joined to form a five-sided enclosure that provides exceptional insulation for food and beverages and other items stored in the soft-side cooler. In some embodiments, the single piece of closed-cell foam can comprise contouring about the top edge of the insulating core that permits an upper section of to fold over an insulating compartment when the soft-side cooler is zipped to provide a sixth side of insulation.

The soft-side cooler may comprise a zipper mechanism that allows for zipping down the middle of the top of the soft-side cooler. The zipper mechanism can allow for wide-mouth opening that provides a user easy access to the insulated compartment. Further, as will be understood, the zipper can transition the cooler to and from open and closed positions. In some configurations, when the cooler is in the open potion, the upper portions of the first and second vertical walls are substantially parallel with the lower portions of the first and second vertical walls, and when the cooler is in the closed position, the upper portions of the first and second vertical walls are substantially perpendicular to the lower portions of the first and second vertical walls. Thus, in the closed positions, the upper portions join to form a sixth side of insulation. In some embodiments, the zipper configuration may comprise an outer lip, an inner lip, and a zipper. In certain embodiments, the zipper mechanism comprises a zipper tape that can be sandwiched between the outer lip and the inner lip. The zipper configuration may further comprise a strap that minimizes or eliminates openings where the zipper mechanism attaches to the body of the cooler thus increasing the insulating capacity of the cooler. In some embodiments, the zipper mechanism is configured to cause opposing upper sections of the insulating core to fold in toward one another when the zipper is zipped to a closed position. Further, the zipper may be configured and incorporated into the cooler in a manner that is secure, increases the insulating capacity of the cooler, and provides an appealing, finished product.

The foregoing summarizes only a few aspects of the presently disclosed subject matter and is not intended to be reflective of the full scope of the presently disclosed subject matter as claimed. Additional features and advantages of the presently disclosed subject matter are set forth in the following description, may be apparent from the description, or may be learned by practicing the presently disclosed subject matter. Moreover, both the foregoing summary and following detailed description are exemplary and explanatory and are intended to provide further explanation of the presently disclosed subject matter as claimed.

BRIEF DESCRIPTION OF THE DRAWINGS

The accompanying drawings, which are incorporated in and constitute a part of this specification, illustrate multiple embodiments of the presently disclosed subject matter and, together with the description, serve to explain the principles of the presently disclosed subject matter; and, furthermore, are not intended in any manner to limit the scope of the presently disclosed subject matter.

DETAILED DESCRIPTION

Figure 1:
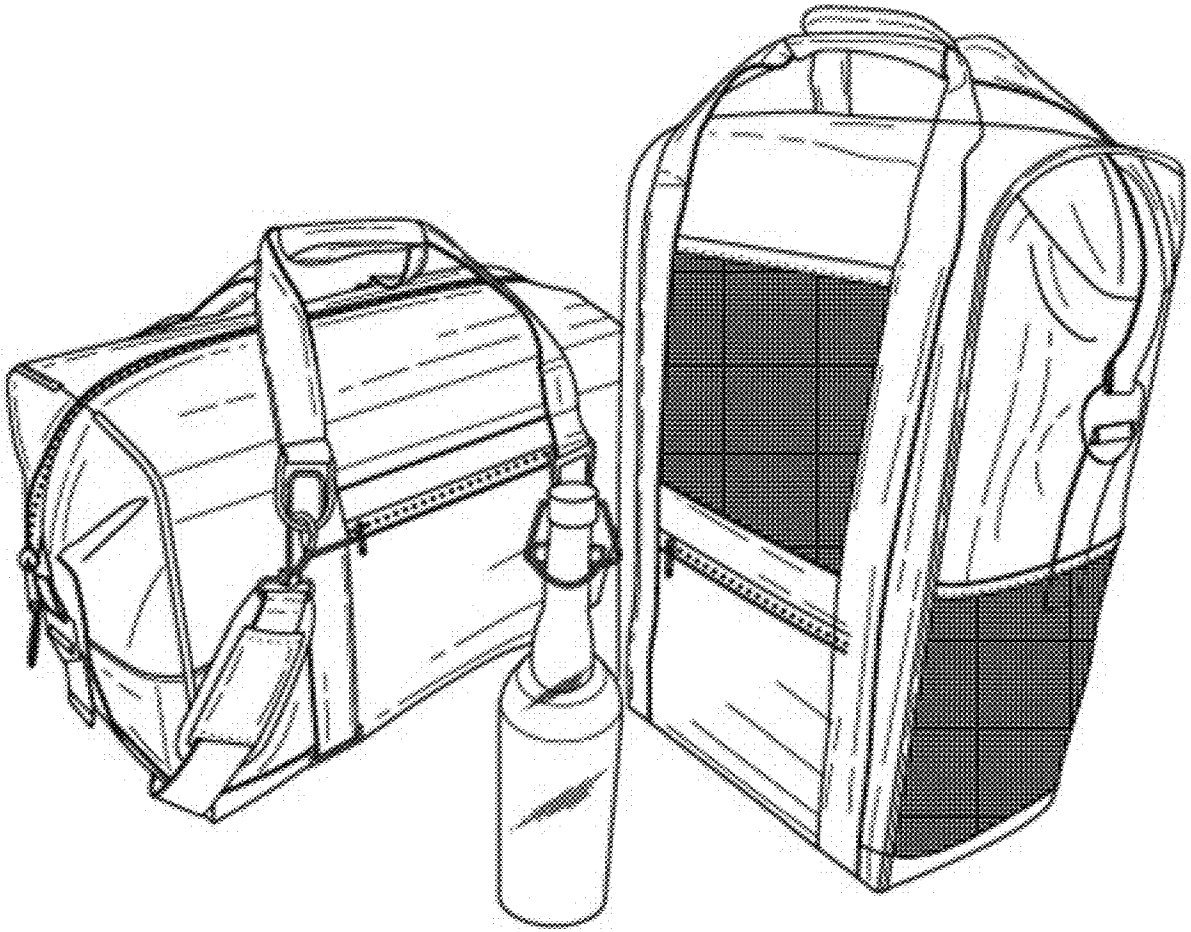
FIG. 1 illustrates a soft-side cooler and a backpack-style soft-side cooler, in accordance with an exemplary embodiment of the presently disclosed subject matter.

The various embodiments of the presently disclosed subject matter are described with specificity to meet statutory requirements. However, the description itself is not intended to limit the scope of this patent. Rather, it has been contemplated that the claimed subject matter might also be embodied in other ways, to include different steps or elements similar to the ones described in this document, in conjunction with other present or future technologies.

It should also be noted that, as used in the specification and the appended claims, the singular forms "a," "an" and "the" include plural references unless the context clearly dictates otherwise. References to a composition containing "a" constituent is intended to include other constituents in addition to the one named. Also, in describing the preferred embodiments, terminology will be resorted to for the sake of clarity. It is intended that each term contemplates its broadest meaning as understood by those skilled in the art and includes all technical equivalents which operate in a similar manner to accomplish a similar purpose.

Herein, the use of terms such as "having," "has," "including," or "includes" are open-ended and are intended to have the same meaning as terms such as "comprising" or "comprises" and not preclude the presence of other structure, material, or acts. Similarly, though the use of terms such as "can" or "may" is intended to be open-ended and to reflect that structure, material, or acts are not necessary, the failure to use such terms is not intended to reflect that structure, material, or acts are essential. To the extent that structure, material, or acts are presently considered to be essential, they are identified as such.

It is also to be understood that the mention of one or more method steps does not preclude the presence of additional method steps or intervening method steps between those steps expressly identified. Moreover, although the term "step" may be used herein to connote different aspects of methods employed, the term should not be interpreted as implying any particular order among or between various steps herein disclosed unless and except when the order of individual steps is explicitly required.

The components described hereinafter as making up various elements of the invention are intended to be illustrative and not restrictive. Many suitable components that would perform the same or similar functions as the components described herein are intended to be embraced within the scope of the invention. Such other components not described herein can include, but are not limited to, for example, similar components that are developed after development of the presently disclosed subject matter.

To facilitate an understanding of the principles and features of the invention, various illustrative embodiments are explained below. In particular, the presently disclosed subject matter is described in the context of a waterproof, leak-proof, soft-side cooler that demonstrates improved insulative capacity.

Referring now to the figures, wherein like reference numerals represent like parts throughout the views, the connector system will be described in detail.

FIG. 1 depicts an exemplary soft-side cooler and backpack-style soft-side cooler according to various aspects of the present disclosure. According to various embodiments, the soft-side cooler and backpack-style soft-side cooler, which comprises backpack straps affixed to the cooler body, comprise a closed-cell foam design to provide exceptional temperature-maintaining performance. Further, aspects of the present disclosure, including the closed-cell foam design (i.e. insulating core), inner liner, and outer shell, make the soft-side coolers both water- and leak-proof. In some embodiments, as shown in FIG. 1 and as will be described below, soft-side coolers according to the present disclosure may be configured to zip down the middle of the top surface. In some embodiments, the ends of the zipper configuration may be affixed to a strap comprising a loop with a buckle, which can secure the strap to the sides of the soft-side cooler.

Figure 2:
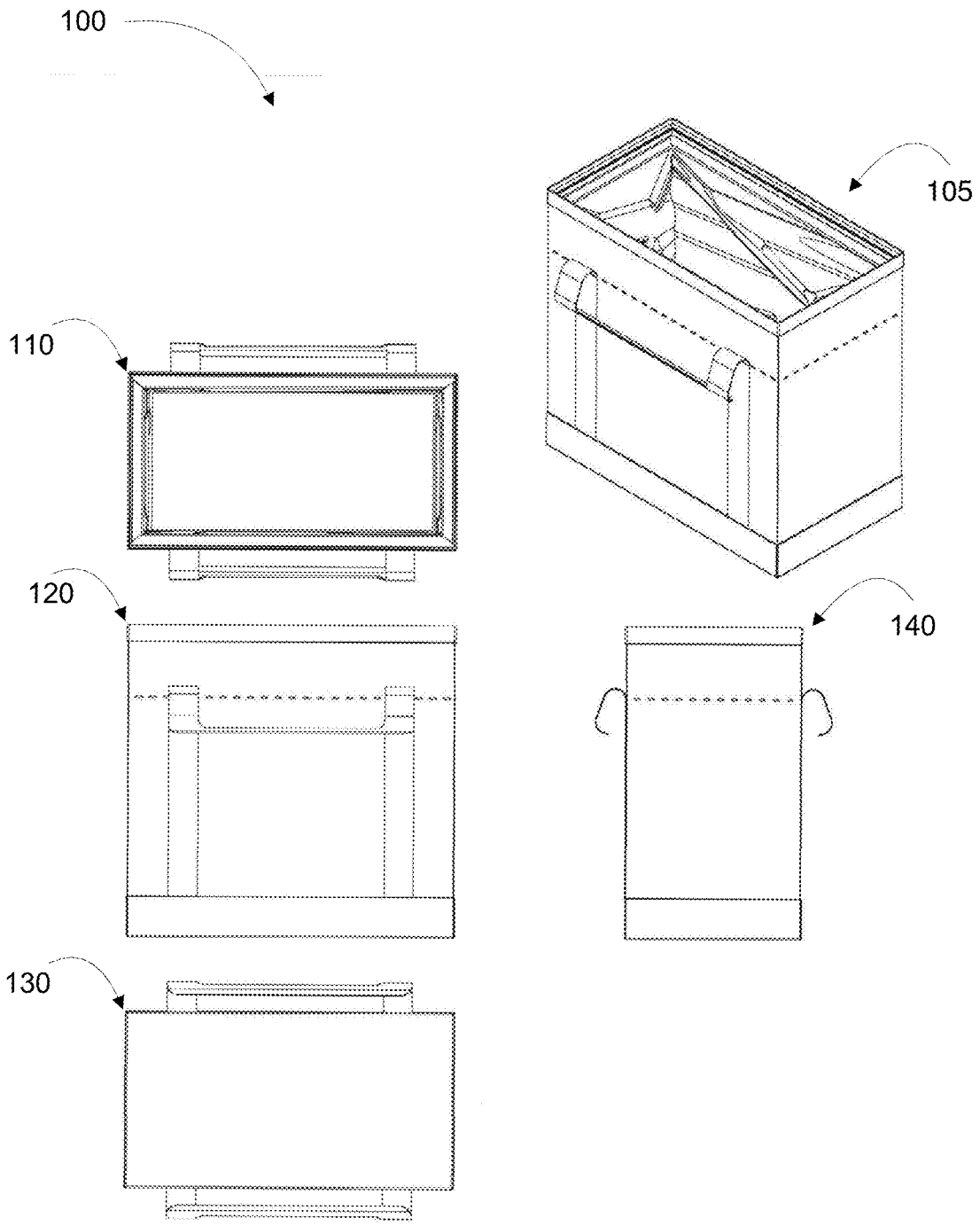
FIG. 2 shows various views of a soft-side cooler, in accordance with an exemplary embodiment of the presently disclosed subject matter.

FIG. 2 includes various views of an exemplary construction of a soft-side cooler 100, according to some embodiments of the present disclosure. In particular, FIG. 2 includes a perspective view 105, top view 110, a side view 120, a bottom view 130, and an end view 140 of an exemplary soft-side cooler 100, according to some embodiments. A soft-side cooler 100 of the present disclosure may be approximately rectangular in shape, as shown in FIG. 2, though the shape and size can be altered to fit particular circumstances and needs of customers.

Figure 3A:
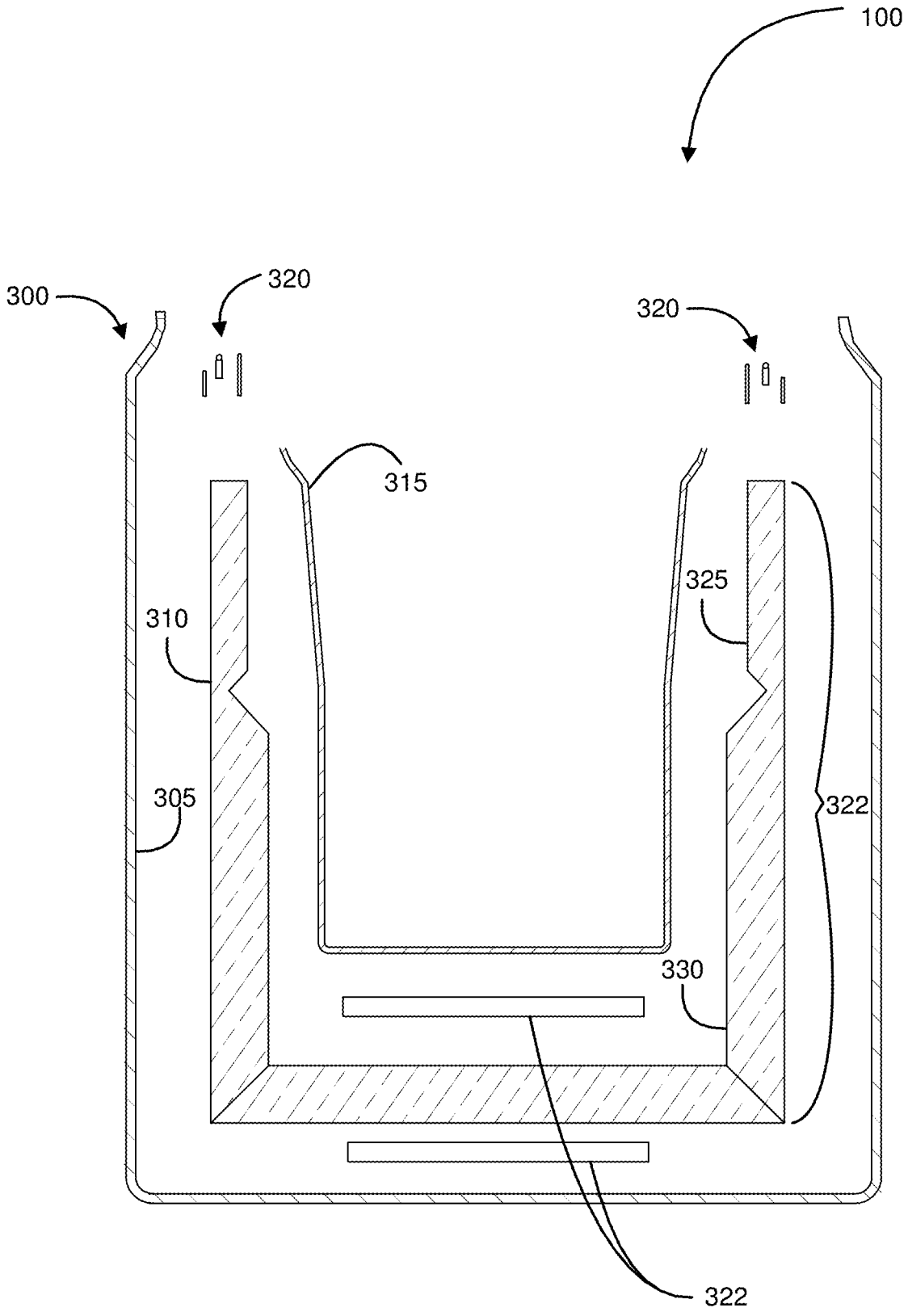
FIG. 3A is an exploded view showing the various components of a soft-side cooler, in accordance with an exemplary embodiment of the presently disclosed subject matter.
Figure 3B:
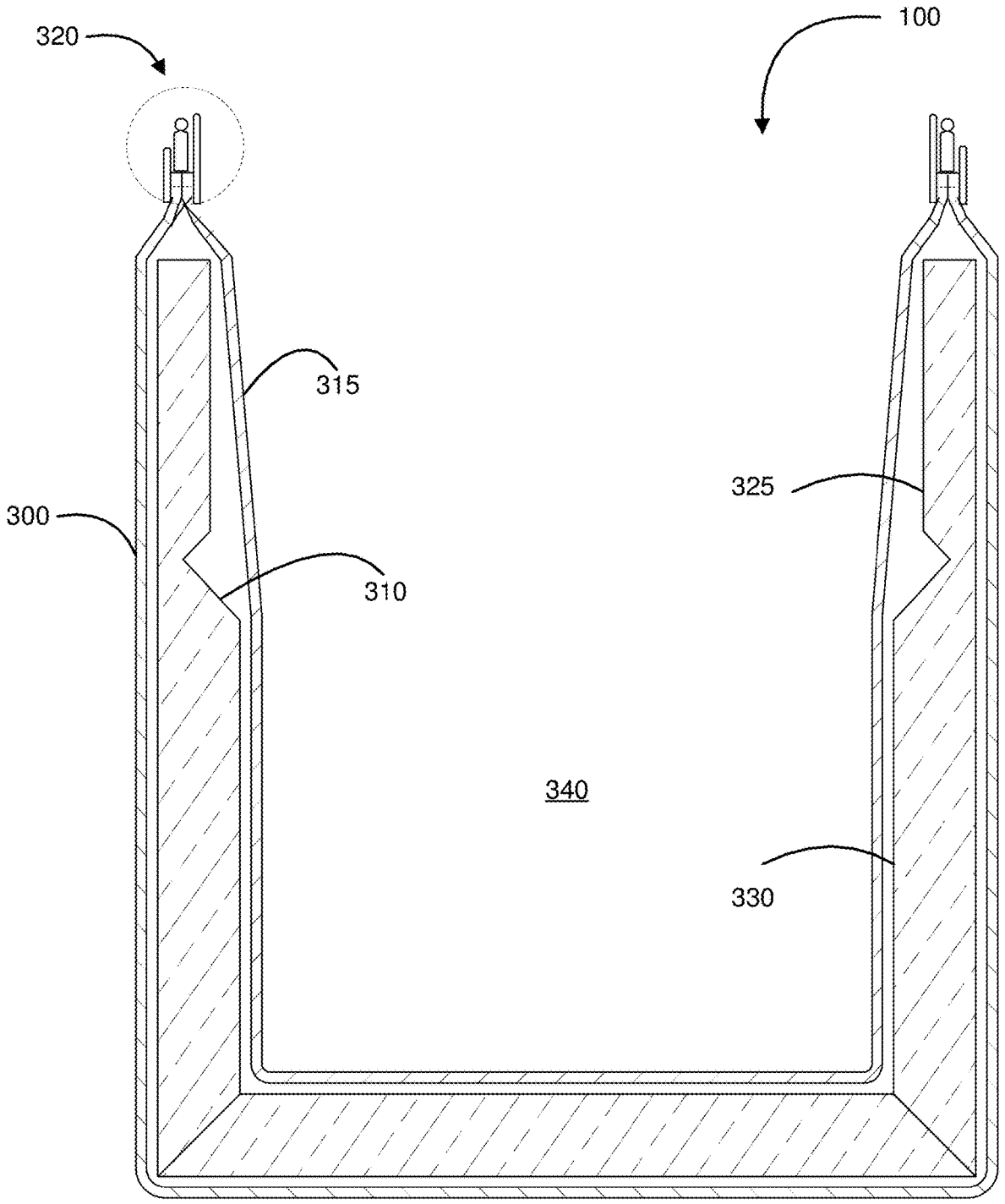
FIG. 3B is a cross-sectional side view of a soft-side cooler in an open position, in accordance with an exemplary embodiment of the presently disclosed subject matter.
Figure 3C:
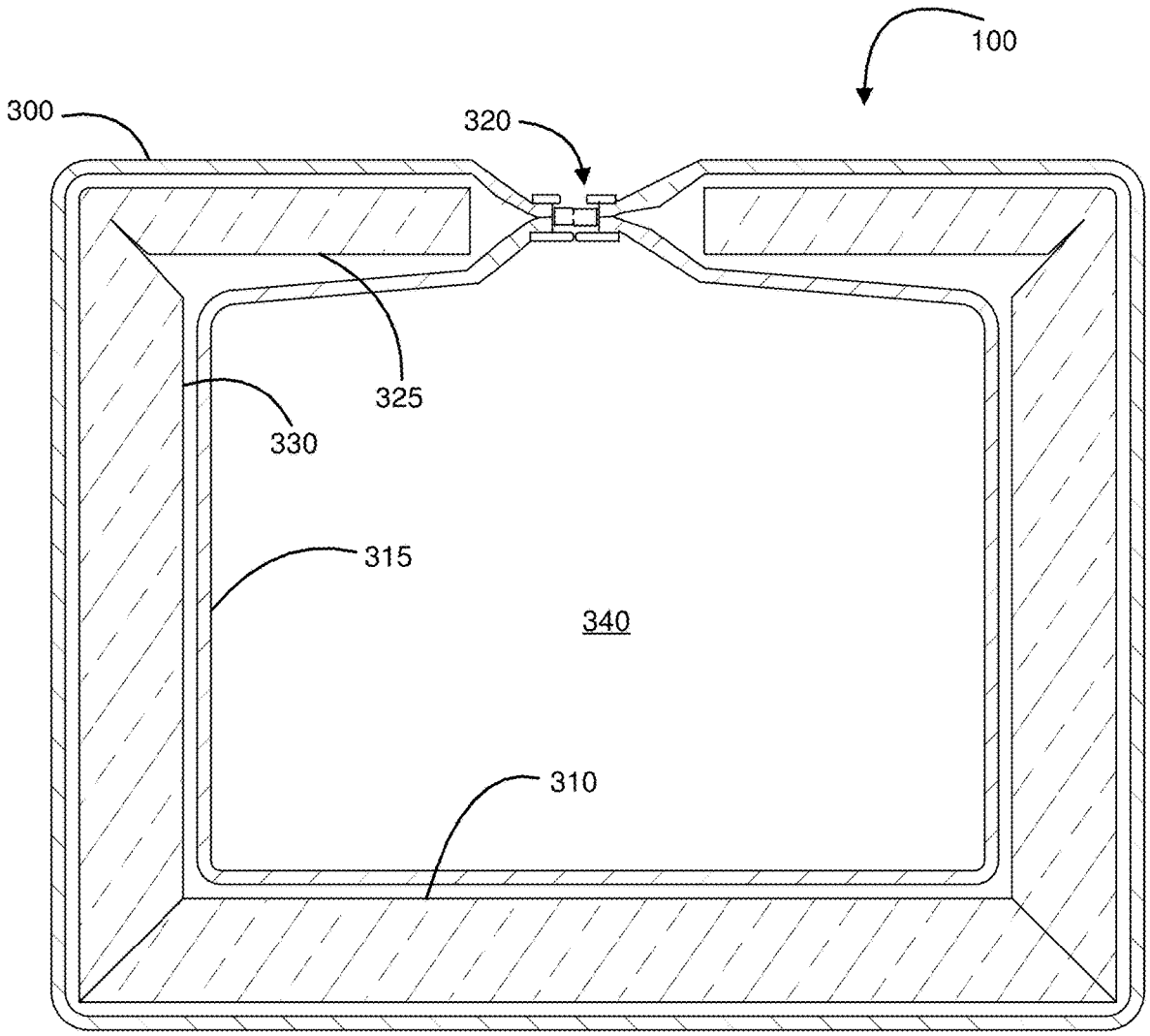
FIG. 3C is a cross-sectional side view of a soft-side cooler in a closed position, in accordance with an exemplary embodiment of the presently disclosed subject matter.

As discussed, according to some embodiments, a soft-side cooler 100 can comprise a three-layer design. FIGS. 3A-3C depict cross-sectional views illustrating an exemplary three-layer design of a soft-side cooler 100. FIG. 3A is an exploded view of a soft-side cooler 100, according to some embodiments. A soft-side cooler 100 may comprise an outer shell 300, an inner liner 315, an insulating core 310, and a zipper mechanism 320 (discussed in more detail with respect to FIGS. 6A-6E). The insulating core 310 may be composed of closed-cell foam and be disposed between the outer shell 300 and the inner liner 315. In some embodiments, the insulating core 310 can be in direct contact with or adhered to the outer shell 300 and/or the inner liner 315. For example, in some embodiments, the insulating core 310 can be adhered or affixed to the outer shell 300 with double-sided tape 322. Similarly, the insulating core 310 can be adhered or affixed to the inner liner 315 with double-sided tape 322. As shown in FIG. 3A, double-sided tape 322 can affix or adhere the insulating core 310 to the bottom of the outer shell 300. Similarly, double-sided tape 322 can be used to affix or adhere the bottom of the inner liner 315 to the insulating core 310. Additionally, though not shown, double-sided tape 322 can be used to adhere vertical surfaces of the insulating core 310 to vertical surfaces of the outer shell 300 and/or the inner liner 315. Further, other adhesion mechanisms or methods can be utilized to affix or adhere the insulating core 310 to the outer shell 300 and/or the inner liner 315. For example, in some embodiments, hook-and-loop fasteners, epoxy, adhesive, glue, cement, polyurethane, or other products can be used to affix or adhere the insulating core 310 to the outer shell 300 and/or the inner liner 315.

In some embodiments, the inner surface 305 of the outer shell 300 (i.e., the surface that can be in direct contact with the insulating core 310) can be coated with or comprise a reflective material. As will be appreciated, the reflective material can reflect cooler temperatures from the interior of the cooler 100 back toward the cooler's 100 interior. Further, the reflective material can reflect warmer, external temperatures, away from the interior of the soft-side cooler 100.

In some embodiments, the outer shell 300 can be constructed from a durable, pliable material that is adapted to promote temperature maintenance and prevent leaking. Further, in some embodiments, the outer shell 300 can be waterproof to keep the soft-side cooler 100 from leaking or prevent outside substances from entering the cooler body. In some embodiments, the outer shell 300 may be constructed from various materials such as denier nylon, which may incorporate UV reflection. Further, the outer shell 300 may comprise a thermoplastic elastomer (TPE) coating. For example, in some embodiments, the outer shell 300 may comprise TPE-coated nylon, 1000 denier luggage grade nylon, tarpaulin, or PU-coated nylon depending on the desired properties of the cooler. It is understood that other materials may be used to construct the outer shell 200. As will be appreciated, such features can help the soft-side cooler 100 maintain interior temperature despite exposure to direct sunlight. It is understood that other materials may be used to construct the outer shell 300 that will provide similar functionalities and advantages.

In some embodiments, the outer shell 300 can include various accessories to serve various needs. For example, in some embodiments, the outer shell 300 may include backpack straps such that the soft-side cooler 100 can be transported on a user's back as a backpack. In some embodiments, the outer shell 300 may comprise a plurality of side-release buckles, which can also serve as bottle openers. Further, the outer shell 300 may be equipped with a plurality of tie downs. In some embodiments, the tie downs may be constructed from stainless steel. Further, the outer shell 300 may comprise a plurality of carabiners, which can be carabiner bowtie daisy chains. As will be understood and appreciated, the tie downs and carabiners can be used to secure the soft-side cooler to a variety of surfaces or objects.

As shown at FIG. 3A, in some embodiments, an inner liner 315 can be disposed within the insulating core 310. In some embodiments, the inner liner 315 can be constructed from a pliable, waterproof material. For example, the inner liner 315 can be constructed from thermoplastic polyurethane (TPU), which can be eco-friendly and is FDA-approved for storage of perishables. In some embodiments, the seams of the inner liner can be welded, thus helping to ensure that the inner liner 315 is leak-proof and sweat-proof. Further, in some embodiments, the inner liner 315 can be puncture-resistant and flexible, which further helps to ensure that the inner liner 315 will neither leak nor sweat. In some embodiments, the inner liner 315 can be crack-resistant to temperatures down to −70° F. Similarly, in some embodiments, the inner liner 315 can be removable from the soft-side cooler 100, which, as will be appreciated, allows users to wash the inner liner 315, thus keeping it clean and extending its useful life.

As previously discussed, in some embodiments, the insulating core 310 can be constructed from closed-cell foam. The closed-cell foam can serve a dual purpose: prevent warm air from entering the interior of the cooler 100 and keep cold air from leaving the interior of the cooler 100. Additionally, as will be appreciated, closed-cell foam is more rigid than open-cell foam, thereby providing for a more structured interior. Further, as will be appreciated, because closed-cell foam can be folded, bent, and carved, the use of closed-cell foam can allow for an insulating core 310 that can be constructed from a single piece, as will be discussed further in relation to FIG. 4B.

In some embodiments, the insulating core 310 may comprise opposing vertical walls (or side walls) 322, which may comprise an upper section 325 and lower section 330. In some embodiments, the upper sections 325 are opposing and can fold over toward one another and over the insulating compartment thereby providing six-sided insulation. Further, in some embodiments, the upper sections 325 may have a thickness that is less than the thickness of the lower sections 330. FIGS. 3B and 3C illustrate a soft-side cooler 100 in an open position and a closed position, respectively, according to some embodiments. As shown in FIG. 3B, once the inner liner 315 is inserted into the interior of the insulating core 310, the soft-side cooler 100 can comprise an insulating compartment 340. Further, as shown in FIG. 3B, the cooler 100 is in an open position as both the upper section 325 and lower section 330 are substantially aligned in a vertical position. In FIG. 3C, the cooler 100 is in a closed position in which the upper sections 325 have been folded in toward one another such that the upper sections 325 are substantially perpendicular to the lower sections 330.

Figure 4A:
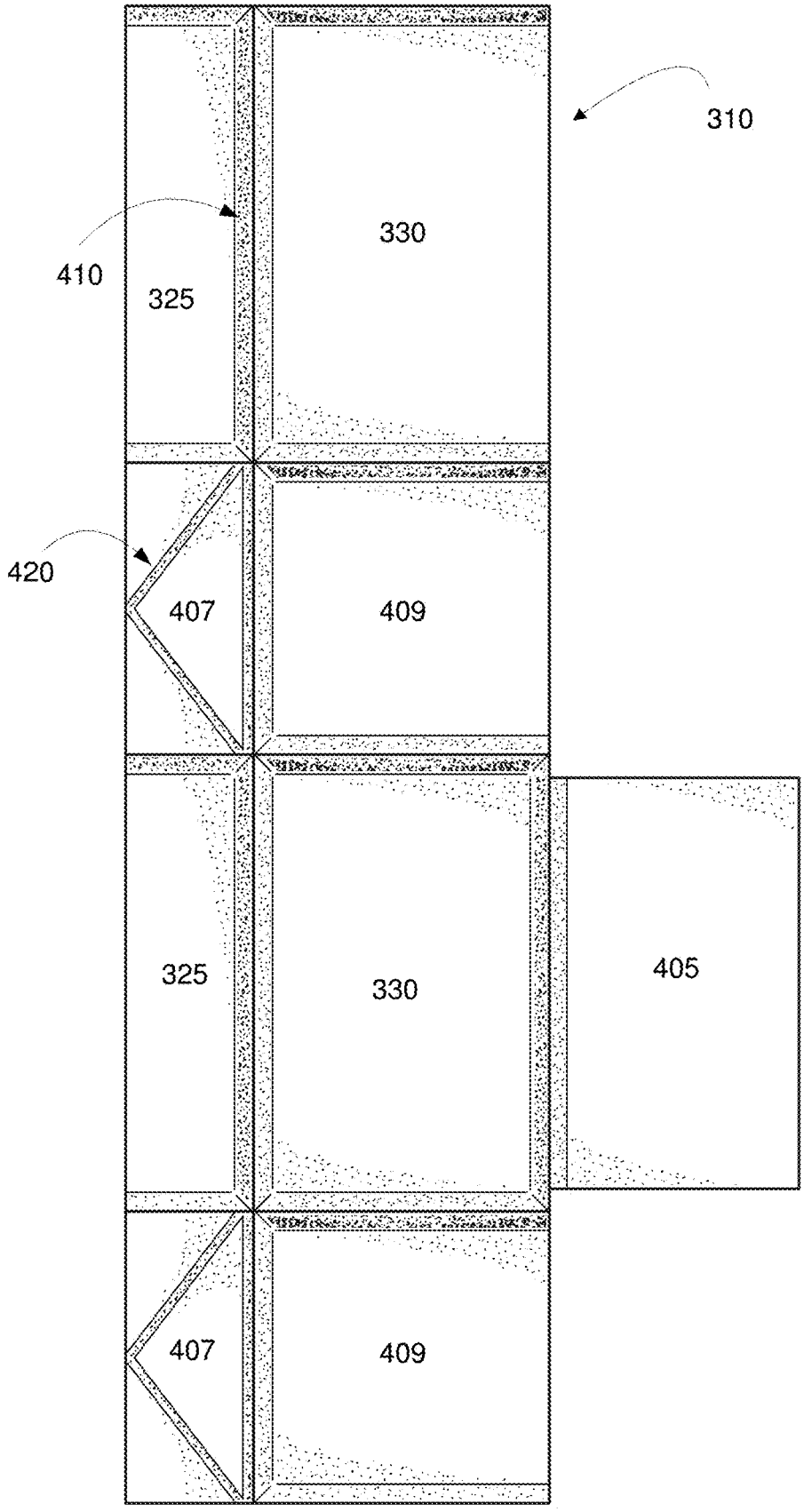
FIG. 4A is a single piece of foam configured as a template for an insulating core, in accordance with an exemplary embodiment of the presently disclosed subject matter.
Figure 4B:
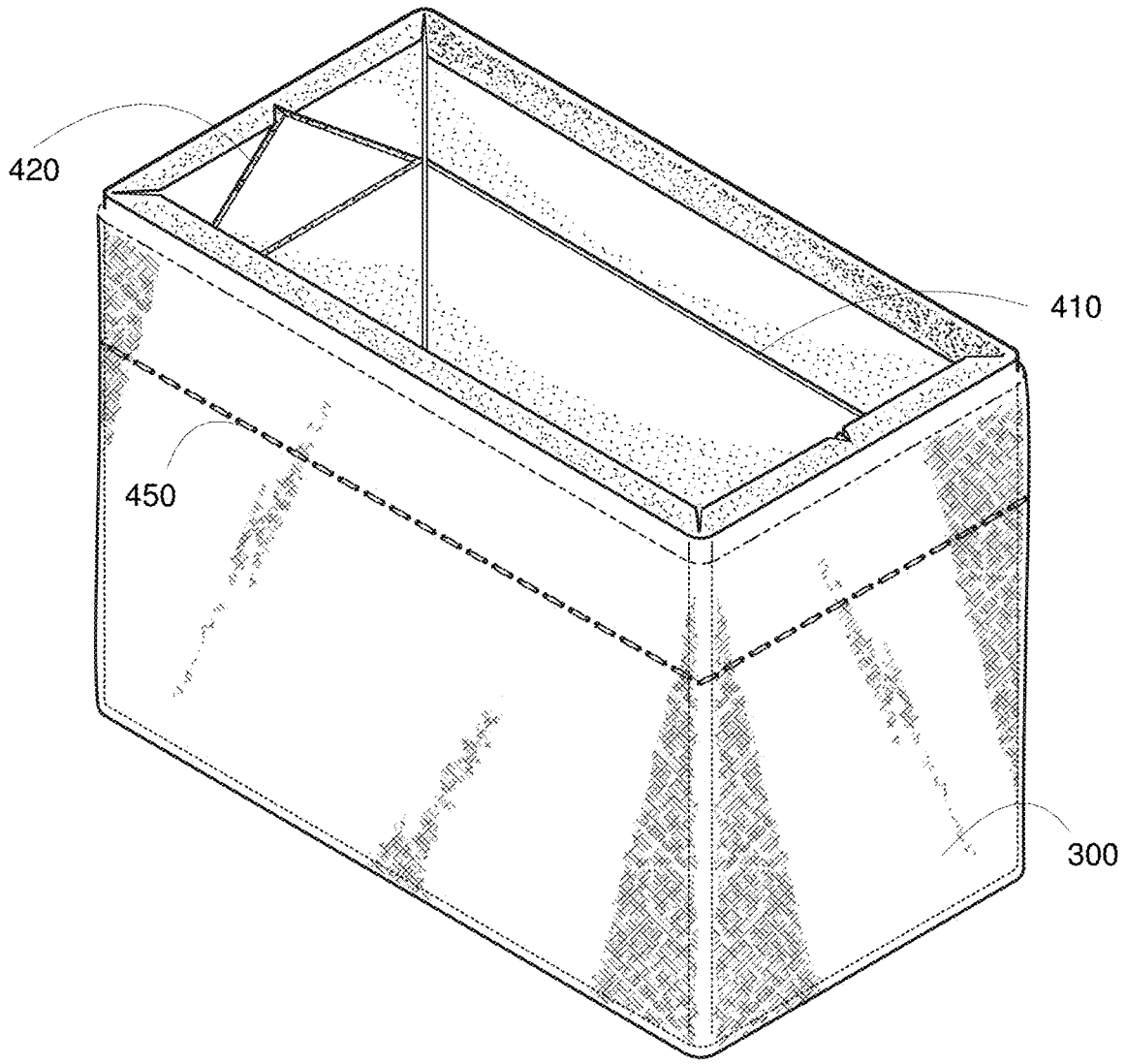
FIG. 4B is a soft-side cooler in which the insulating core is inserted into the outer shell, in accordance with an exemplary embodiment of the presently disclosed subject matter

In some embodiments, as shown in FIGS. 4A and 4B, an insulating core 310 can be constructed from a single piece of closed-cell foam. The single piece of closed-cell foam can be a template configured for constructing the insulating core 310 and can comprise both triangular contours 420 and straight-line contours 410 that delineate various foam sections that comprise the overall insulating core 310. For example, the contours 420, 410 can be carved out of the closed-cell foam, as shown in FIG. 4B. The single piece of closed-cell foam can be folded along the contours 410, 420 to form the insulating core 310. In some embodiments, the insulating core 310 may comprise a foam base 405 that aligns with a bottom surface of the soft-sided cooler 100. In some embodiments, the foam base 405 can be seated in a skid-resistant (e.g, rubber-bottom) saddle disposed between the foam base 405 and the outer shell 300. In some embodiments, the insulating core 310 may comprise two opposing vertical walls (or side walls) and two opposing end walls. As shown in FIG. 4A, and as discussed in relation to FIGS. 3B-3C, in some embodiments, a vertical wall may comprise an upper section 325 and a lower section 330. Similarly, in some embodiments, an end wall may comprise an upper section 407 and a lower section 409.

As discussed previously, in some embodiments, the upper sections 325 can be folded toward one another to create a closed state and form a sixth side of insulation. Thus, when the upper sections 325 are folded toward one another, the upper sections 407 of the end walls may further contribute to the sixth side of insulation, according to some embodiments. For example, as shown in FIG. 4A, the contours may include straight lines 410 carved proximate the top of the foam body parallel to the ground, and triangle contours 420 on the end walls. As will be appreciated, these contours can permit the upper section 325 and 407 to fold inward and over the insulating compartment when the fully-formed cooler is zipped, thereby providing six-sided insulation. In some embodiments, the upper sections 325 can meet over the insulating compartment, and the upper sections 407 can move away from the insulating compartment. In other words, when the cooler 100 is zipped, the top will be substantially hexagonal in shape. In some embodiments, when moved away from the insulating compartment, the upper sections 407 can be buckled down so as to provide a compact look. As seen in FIG. 4B, the insulating core 310 can be inserted into an outer shell 300. The outer shell 300 can comprise integral stitching 450 about the sides of the cooler 100 that can help the upper section 325 fold over when the cooler 100 is zipped, thus providing the sixth side of insulation.

As will be appreciated and understood, the foam base and foam body can have various dimensions and foam thicknesses according to the needs of the user. It is understood that the thickness of the foam corresponds to the insulative capacity of the soft-side cooler. According to an example embodiment, the foam base 405 may have a thickness of approximately 1 inch to 1.5 inches. According to an example embodiment, the lower sections 330 and 409 can have a thickness of approximately 0.75 inches to 1 inch. The upper sections 325 and 407 can have a thickness of 0.5 inches to 0.75 inches. Thus in some embodiments, the lower sections 330 and 409 have a greater thickness than the upper sections 325 and 407 of the foam body. As will be understood, these dimensions are exemplary and are not intended to be limiting as the thicknesses of the components can be changed depending on the needs of the soft-side cooler because certain implementations may require maintaining lower or higher temperatures than others. For example, when used in a medical setting to transport human tissue or organs, it may be necessary to maintain a lower temperature than when used to transport food or drinks. Accordingly, it may be necessary for the foam base 305, lower sections 330 and 409, and upper sections 325 and 407 to have greater thicknesses and thus greater insulation capacity.

Figure 5A:
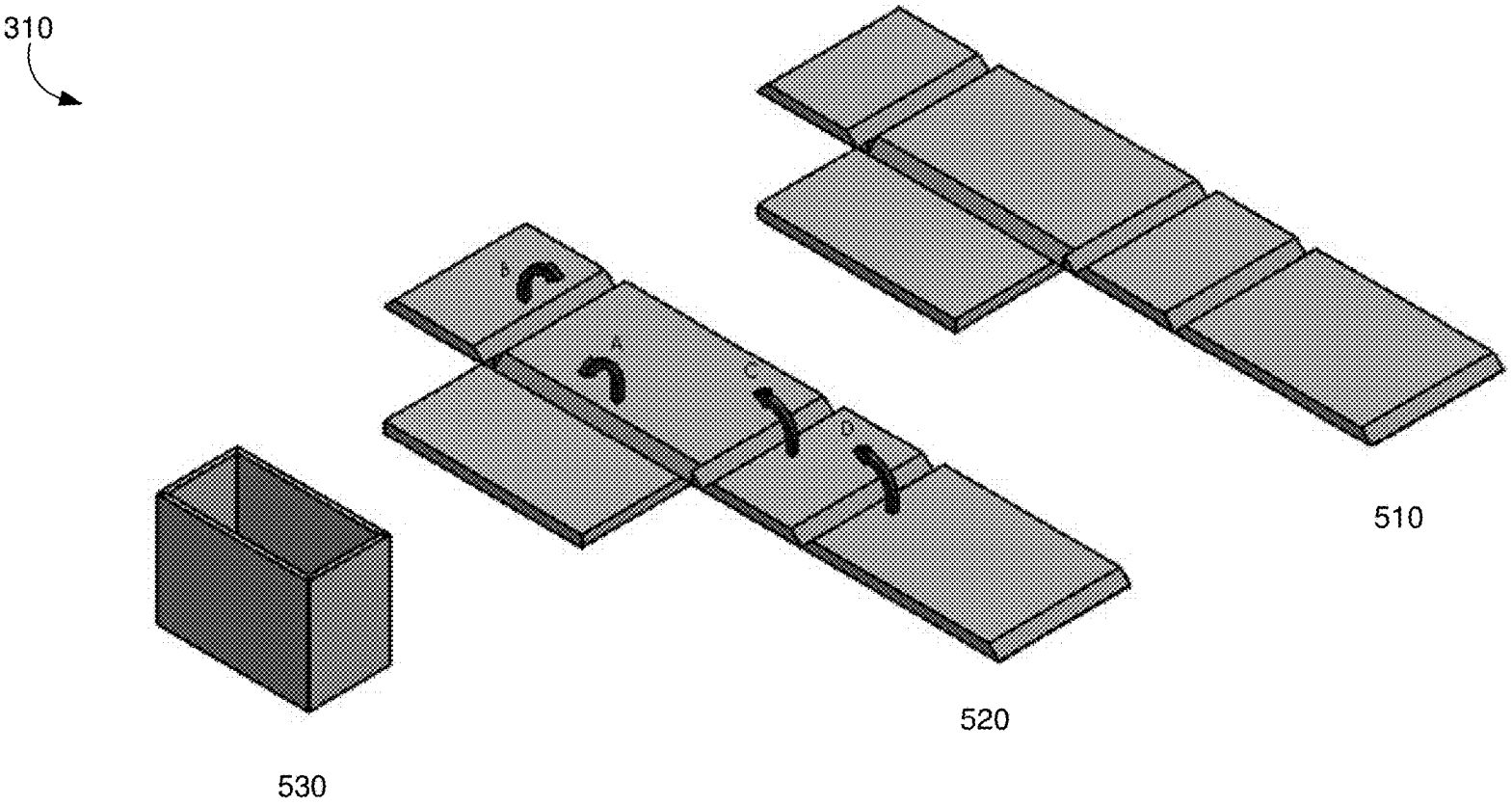
FIGS. 5A-5C illustrate various steps and components for constructing a soft-side cooler, in accordance with another exemplary embodiment of the presently disclosed subject matter.
Figure 5B:
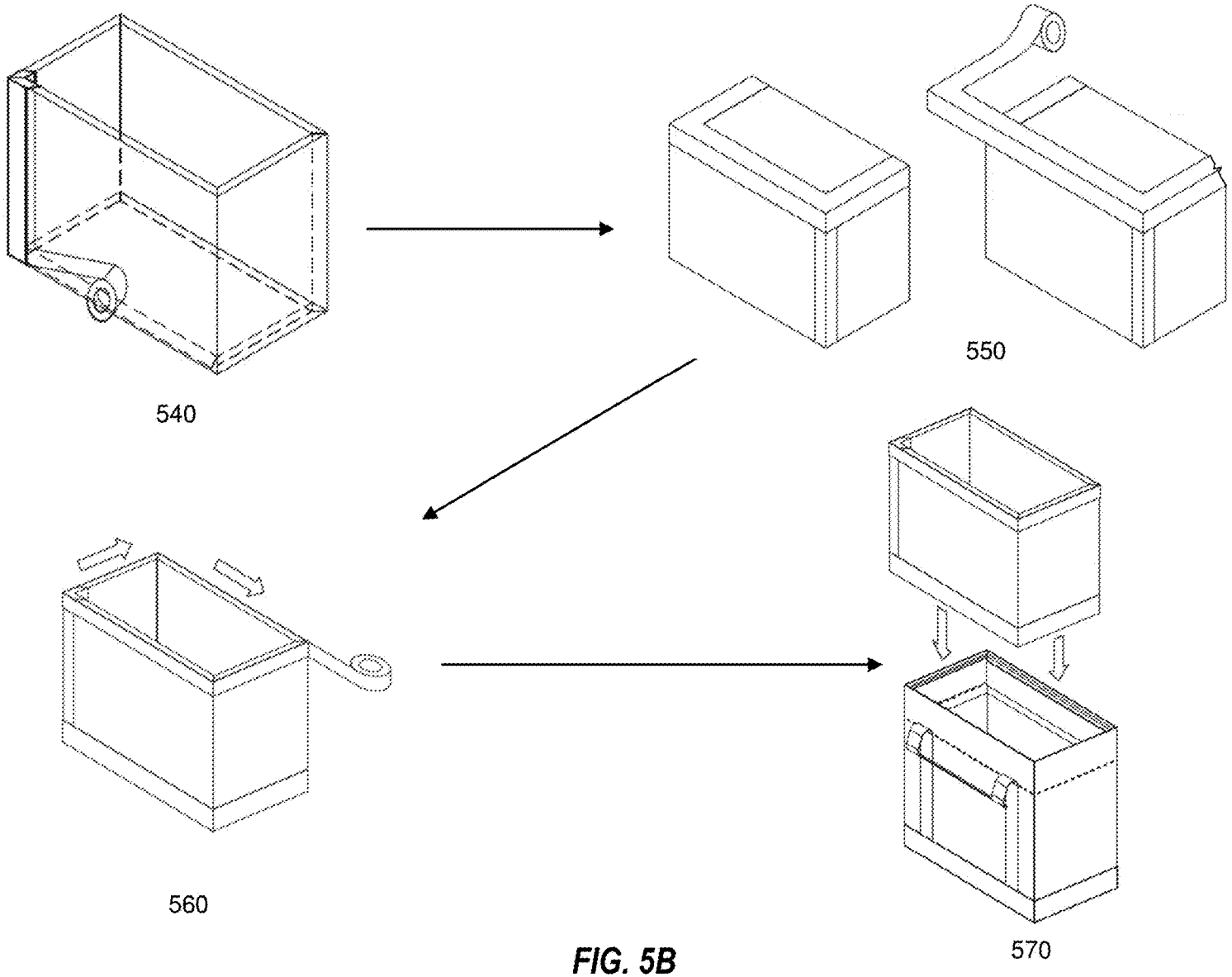
Figure 5C:
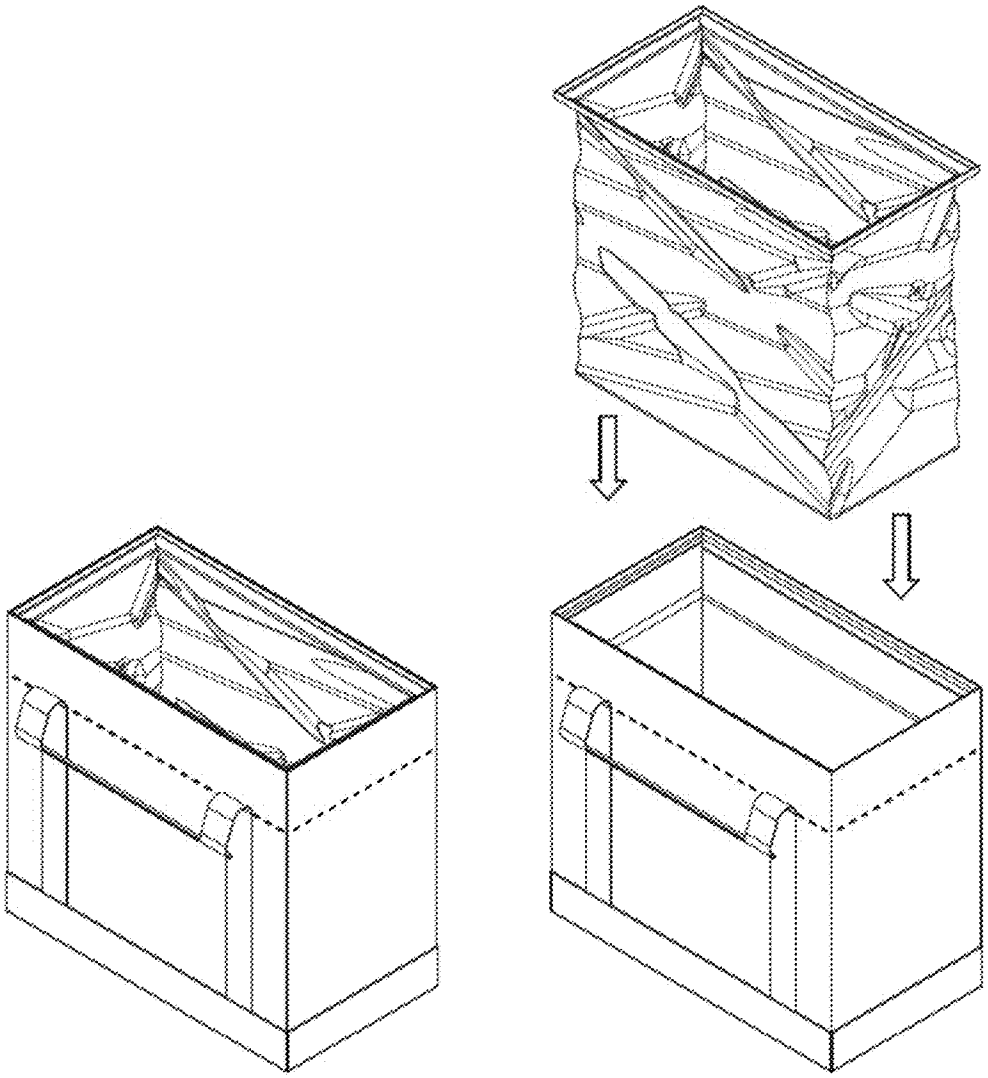

FIGS. 5A-5C illustrate various steps in a method for constructing a soft-side cooler 100, according to some embodiments. As discussed above, in an exemplary embodiment, and as shown in FIG. 5A, an insulating core 310 may be composed of a single piece of closed-cell foam. For example, FIG. 5A shows an example method for forming the closed-cell insulating core 310. A single piece of closed-cell foam can be configured to have five interconnected pieces, as shown at 510, such that, when folded in a particular manner (as illustrated at 520), a five-sided enclosure can be formed that serves as an insulating core 310 (as shown at 530). In some embodiments, as discussed above, the single piece of closed-cell foam can comprise contouring and can be folded about that contouring. The method illustrated in FIG. 5A is not meant to be limiting and is instead meant to provide a visual to better understand an insulating core 310 of the present disclosure that can be constructed from a single piece of closed-cell foam.

FIG. 5B further illustrates an example method for constructing the five-sided enclosure (i.e., insulating core 310) from a single piece of closed-cell foam once the foam is folded. As shown in FIG. 5B at 540 and 550, in some embodiments, tape or other securing mechanisms can be used to attach the edges of the five connected pieces of foam of the single piece of closed-cell foam, thus creating the insulating core 310. As will be appreciated, in addition to securing the edges, the tape or other securing mechanism can ensure the finalized insulating core 310 is watertight. In some embodiments, as shown at 560, an adhesive, such as double-sided tape or other adhesive substance, can be added to the upper portion of the insulating core 310. Further, as discussed above, in other embodiments, adhesive strips can be added to the interior of an outer shell 300. Accordingly, as shown at 570, in some embodiments, the insulating core 310 can be inserted into, and affixed to, the outer shell 300. As will be appreciated, the adhesive can help keep the insulating core 310 in place once it is inserted into the outer shell 300.

In some embodiments, the closed-cell foam can be folded as shown in FIG. 5A to create an insulating core 310 and secured together and placed in the interior of an outer shell 300, as shown in FIG. 5B. Following, as shown in FIG. 5C, after the insulating core 310 is completed, an inner liner 315 can be inserted into the insulating core 310.

Figure 6A:
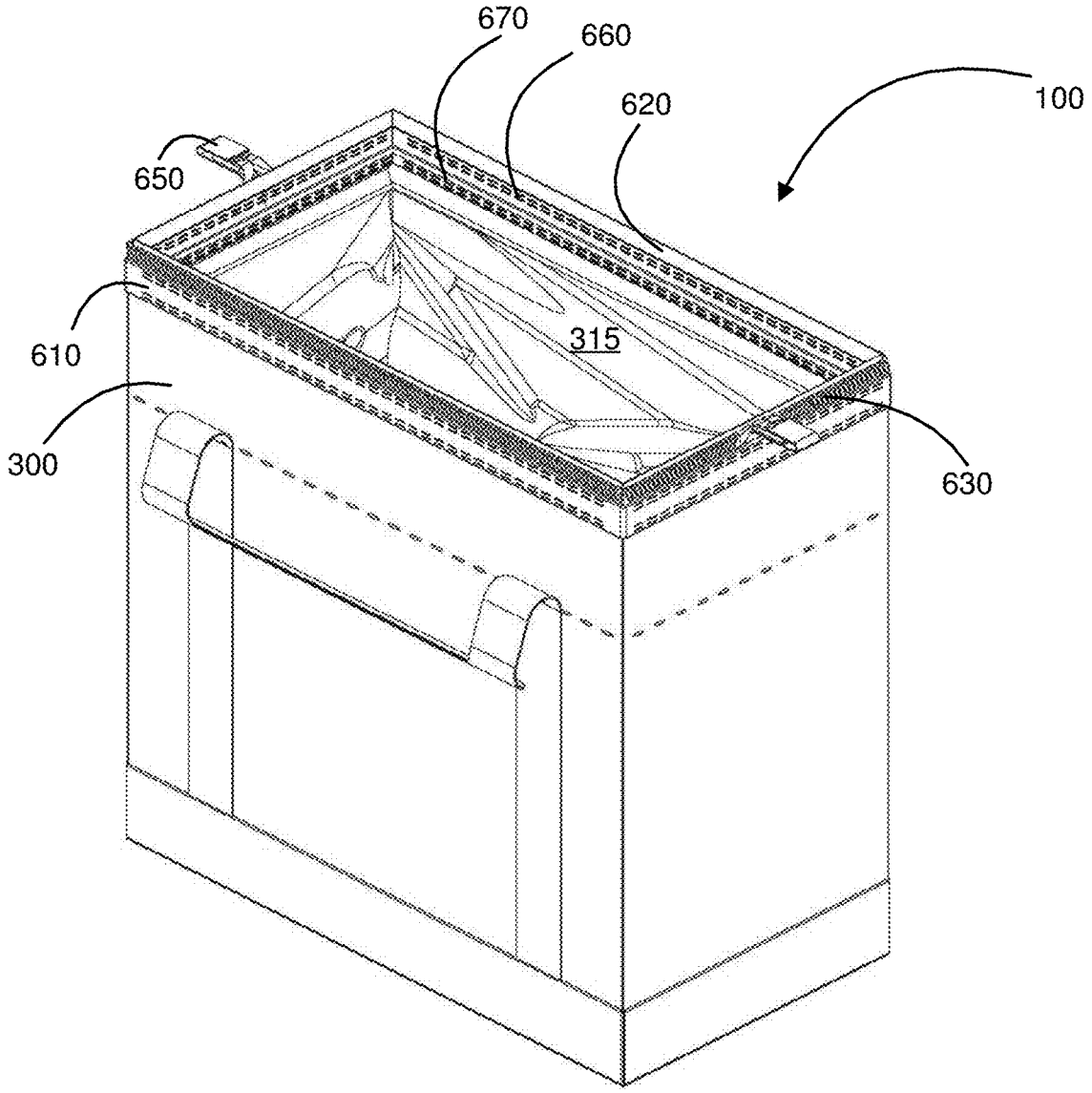
FIGS. 6A-6E illustrate exemplary attachment configurations for a zipper configuration and strap to a soft-side cooler, in accordance with another exemplary embodiment of the presently disclosed subject matter.

FIG. 6A shows an example embodiment of a fully assembled soft-side cooler 100 comprising a zipper configuration, according to various embodiments of the present disclosure. As will be understood by one of skill in the art, a zipper generally comprises opposing rows of interlocking teeth that, when interlocked, are referred to as a chain. Generally, each row of opposing teeth can be affixed to a strip of fabric known as a tape. Collectively, the row of opposing teeth and tape may be referred to as a stringer. Conventionally, zipper stringers are simply sewn into the outer shell of a soft-side cooler; however, it has been observed that attaching the zipper in such a way makes it easy for a zipper to accidentally rip the entire zipper structure out of the cooler.

As shown in FIG. 6A, the soft-side cooler 100 can comprise a zipper mechanism (i.e., zipper configuration) attached proximate the top of the soft-side cooler 100. The zipper mechanism can be configured to transition the cooler to and from open and closed positions. As will be understood, a zipper mechanism naturally comprises a first side and a second side that, when "zipped up" or "zipped together" form the zipper mechanism. In some embodiments and as shown in FIG. 6A, each side of the zipper mechanism can comprise an outer lip 610, which can be constructed from rubber or other flexible materials, an inner lip 620, and a stringer 630, which may comprise teeth and a tape. The outer lip 610 and inner lip 620 can be attached to the outer shell 300 and the inner liner 315 by a lower stitching 670. The zipper tape of the stringer 630 can be disposed between the outer lip 610 and the inner lip 620 and secured via an upper stitching 660. Thus the inner lip 620 and the outer lip 610 can sandwich the zipper tape of the stringer 630. In some embodiments, the outer lip 610 can be shorter than the inner lip 620 as seen in FIGS. 3A-3C. In some embodiments, the soft-side cooler 100 can also comprise straps 650 on each of the opposing ends of the cooler 100. In some embodiments, the straps 650 can fold over the opposing ends of the zipper 630. In an example embodiment, the straps 650 can then be buckled down the sides of the soft-side cooler 100, permitting a clean and compact look. Further, the straps 650 can help to prevent holes or air gaps when the zipper 630 is attached to the cooler 100.

Figure 6B:
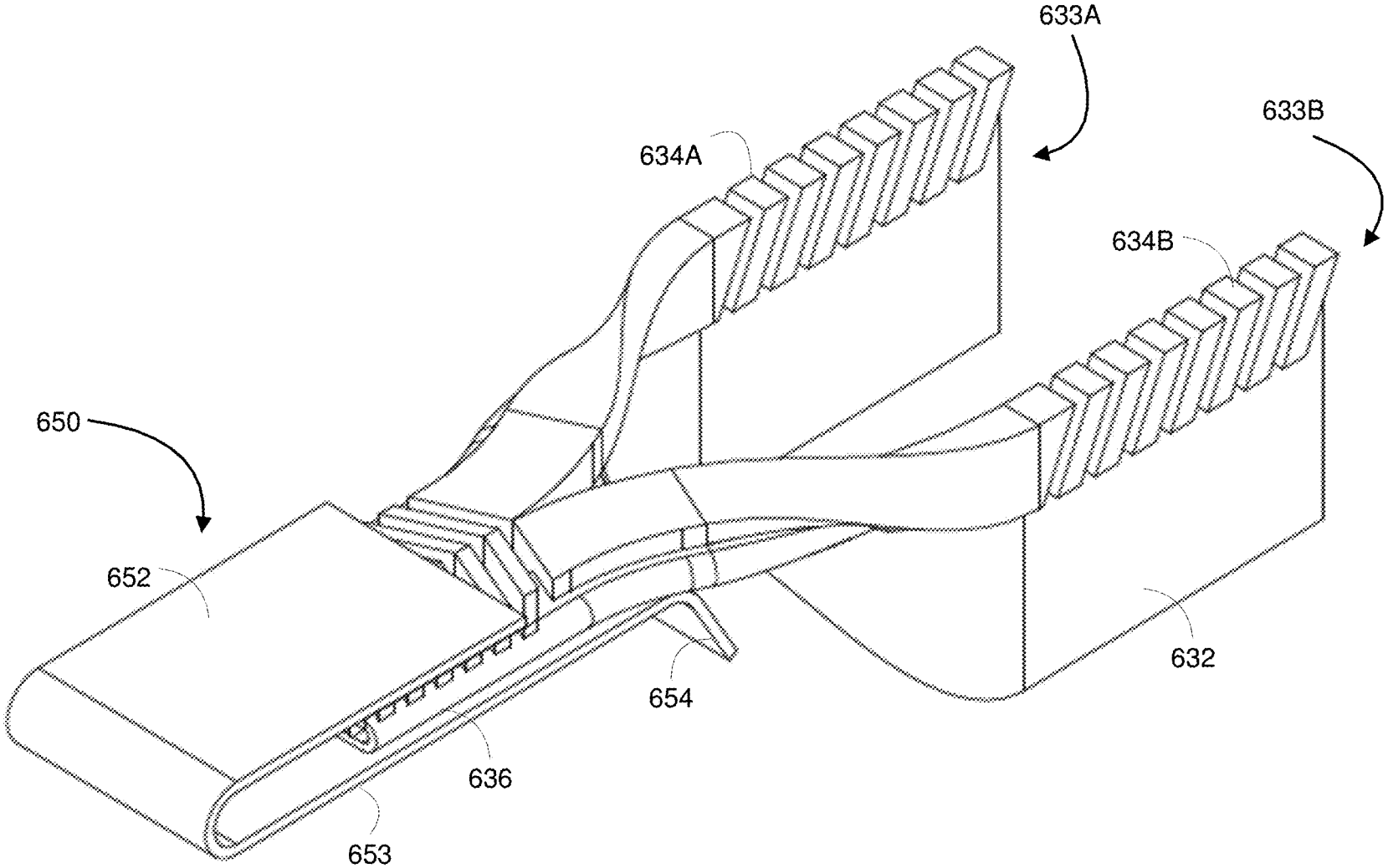
Figure 6C:
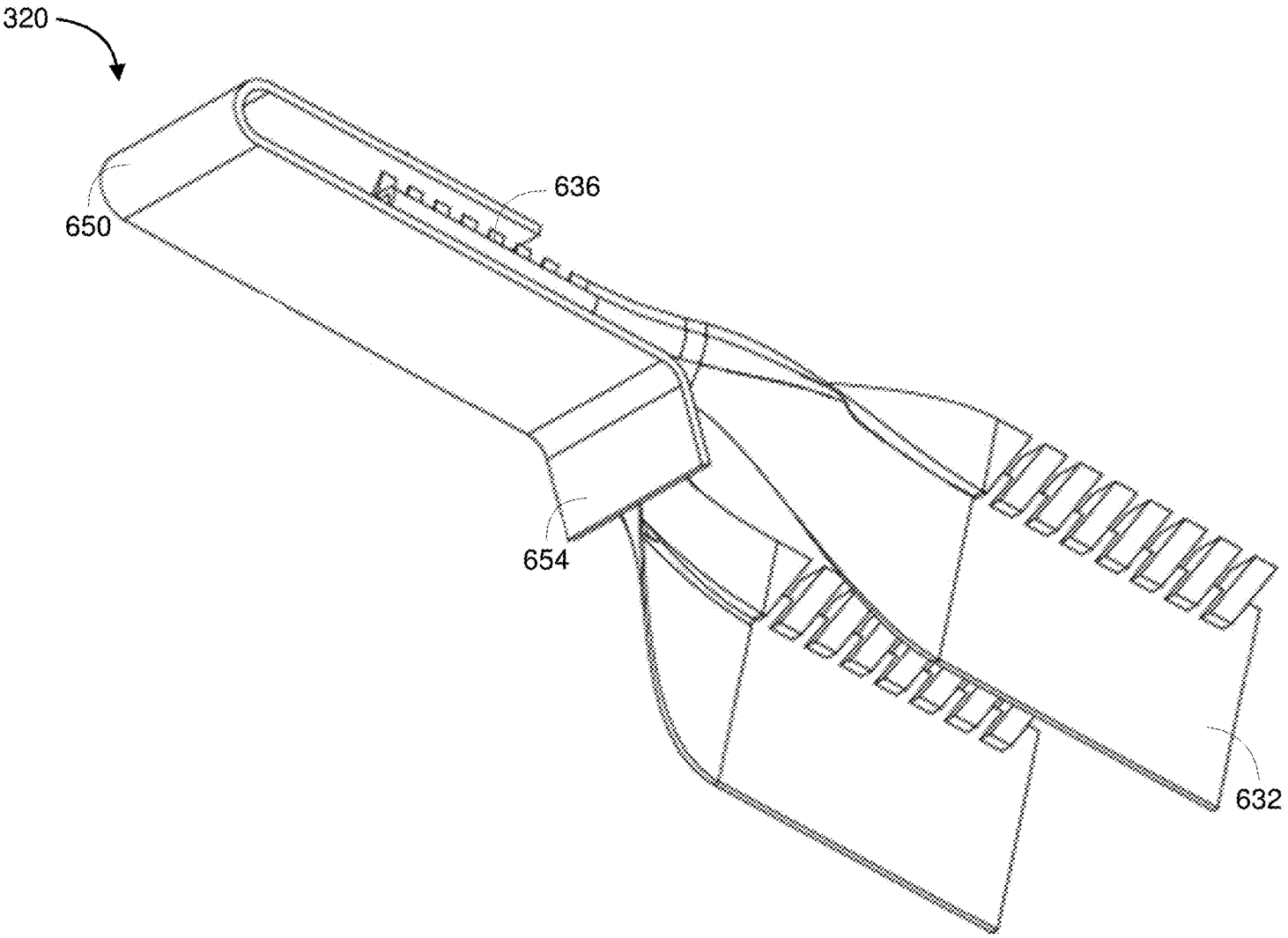

FIGS. 6B and 6C illustrate an example zipper mechanism 320 according to some embodiments of the present disclosure. As will be appreciated and understood, the zipper can adhere to the soft-side cooler 100 in a similar manner to that discussed with respect to FIG. 6A. The zipper mechanism 320 can comprise opposing stringers 633A and 633B, each of which comprise rows of interlocking teeth (634A and 634B, respectively) that interlock to form a chain, and a zipper slider (i.e., the component that "zips" the zipper and causes the interlocking teeth 634A and 634B to interlock and disengage) as shown in FIG. 1. In some embodiments, the zipper mechanism may comprise a bottom stop that is positioned at one end. In some embodiments, the bottom stop is affixed to each of the stringers at the end of the chain, thus holding the stringers together and preventing the slider from leaving the chain. Additionally, as shown in FIG. 6B, the zipper mechanism 320 can comprise a zipper tape 632, as was discussed in relation to FIG. 6A.

In some embodiments of the present disclosure, each pair of opposing ends of the stringer may be affixed to a strap 650. The strap 650 can be constructed from nylon, rubber, or another suitable webbing material that provides strength and flexibility. FIGS. 6B and 6C show an embodiment of one end of a zipper mechanism 320 comprising a strap 650 according to aspects of the present disclosure. As shown, in some embodiments, the strap 650 may be constructed from a single piece of webbing material. In some embodiments, the strap 650 may comprise a top end 652, a bottom end 654, and a middle portion 653 disposed between the top end 652 and bottom end 654. As shown in FIGS. 6B and 6C, in some embodiments, the top end 652 of the strap 650 may be positioned atop an opposing pair of zipper stringers 636 at an end of the zipper mechanism 320. Accordingly, in some embodiments and as shown in FIGS. 6B and 6C, the opposing pair of stringers 636 may be disposed between (i.e., sandwiched between) the top end 652 and the bottom end 654 of the webbing strap. As will be understood, one or more seams traversing the width of the strap 650 may be used to secure the strap 650 in place.

In some embodiments, the zipper tape 632 can comprise an additional rubber strip which attaches to the zipper tape 632 along a length of the cooler. In some embodiments, the rubber strip also attaches within the straps 650 at each of the opposing ends of the zipper stringer 636. As will be appreciated, this additional rubber strip can permit flexibility while zipping because the rubber material will stretch as the zipper is closed. The additional strip can also help prevent the zipper mechanism 632 from ripping off of the cooler 100 and can increase the soft-side cooler's 100 capacity by providing extra flex. Further, in some embodiments, the rubber strip can be attached to the zipper tape 632 and also be sandwiched between the top end 652 and a bottom end 654. In some embodiments, the zipper tape 632 can be constructed from rubber or another flexible material to provide similar functionality.

Figure 6D:
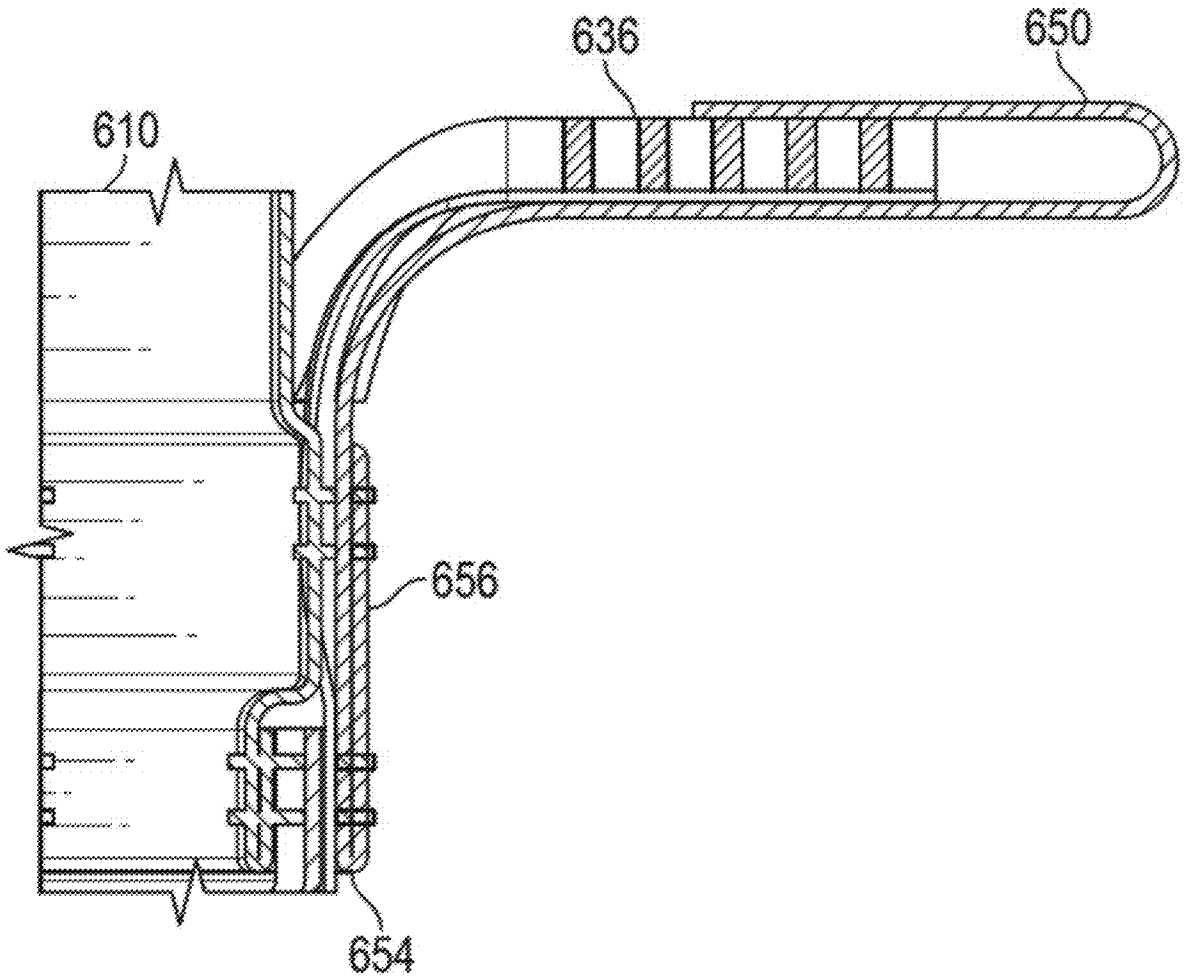

FIG. 6D illustrates an example attachment of the zipper mechanism 320, including the strap 650, as discussed in FIGS. 6B and 6C, according to some embodiments. The strap 650 can loop under the zipper mechanism 320 and be attached over both the zipper stringer 636 and the outer lip 610, thereby covering any hole formed by the zipping mechanism 320. In other embodiments, where a hole is not formed, a strap 650 simply can be attached over the zipper stringer 636 and the outer lip 610. As explained previously, in traditional cooler designs, the zipper and lip attachment may form a hole at the end of the cooler.

As shown at FIG. 6D, in some embodiments, the bottom end 654 of the strap 650 can be attached to the exterior of the cooler 100. For example, as shown in FIG. 6D, the bottom end 654 of the strap 650 can be attached to the outer surface of the outer shell 300 and can attach over the outer lip 610. In another embodiment, the bottom end 654 of the strap 650 can be attached to the inner surface of the inner liner 315 of the soft-side cooler 100. In other embodiments, the bottom end 654 of the strap 650 can be sandwiched between the outer surface of the outer shell 300 and the outer lip 610 or the inner surface of the inner liner 315 and the inner lip 620.

Additionally, as shown in FIG. 6D, in some embodiments, the bottom end 654 of the strap 650 can be doubled over itself to provide added reinforcement. In some embodiments, the strap 650 can be doubled over by looping a second portion 656 of the bottom end 654 away from the cooler body and then collectively affixing or attaching the bottom end 654 and second portion 656 to the cooler body (e.g., the outer shell 300). In other words, the second portion 656 is located at an outermost position as compared to the outer surface of the cooler 100. As will be appreciated, doubling over the bottom end 654 and the second portion 656 in this way can help better secure the strap 650 to the cooler 100. Additionally, as will be appreciated, doubling over the bottom end 654 can help prevent the strap 650 from creating a hole underneath the zipper stringer 636. Additionally, in some embodiments, the looping of the bottom end 654 and the second portion 656 can be reversed such that the second portion 656 abuts the outer surface of the cooler 100.

Further, in some embodiments, the bottom end 654 can be doubled over for added reinforcement. For example, in some embodiments as shown at FIG. 6D, the bottom end 654 can be affixed (e.g., sewn) to the soft-side cooler 100 and then doubled over the stitch. Alternatively, in some embodiments, the bottom end 654 can be doubled over and then affixed (e.g., sewn) to the cooler 100.

Figure 6E:
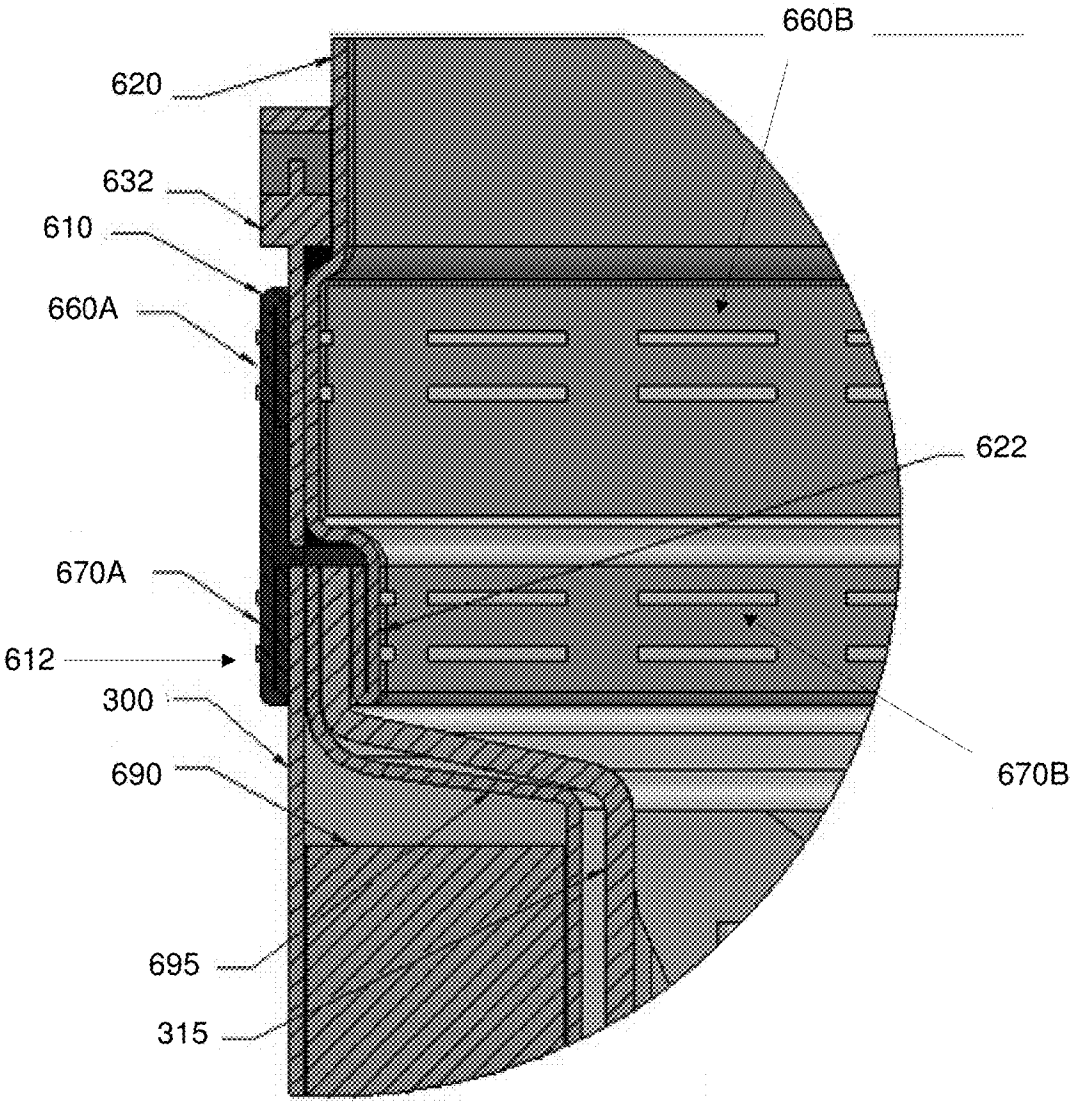

Accordingly, the zipper mechanism 320 as illustrated in FIGS. 6B and 6C can be adhered or affixed to the cooler 100 by various means and following various configurations. FIG. 6E shows a cross-sectional view of an example zipper configuration for use with a soft-side cooler, according to some embodiments. As shown in FIG. 6E, the zipper tape 632 can be affixed to the soft-side coolers in an improved, secure manner.

For example, and as discussed above, a zipper tape 632 of the zipper mechanism can be disposed between an inner lip 620 and an outer lip 610 along the top edge of the soft-side cooler. Accordingly, these three surfaces (i.e., the outer lip 610, zipper tape 632, and inner lip 620) can be stitched together (illustrated by 660A on the outside of the cooler and 660B on the inside of the cooler) along the top edge of the soft-side cooler thus ensuring the zipper is securely affixed to the soft-sided cooler. In some embodiments, the outer lip 610 can be attached to an outer surface of the outer shell 300 and the inner lip 620 can be attached to an inner surface of the inner liner 315 via both upper stitching 660A and 660B and lower stitching 670A and 670B. In some embodiments, the inner lip 620 can be doubled over 622 to provide added strength. Further, in some embodiments and as shown in FIG. 6E, the bottom edge of the outer lip 612 can be doubled under and positioned such that it abuts the outer surface of the outer shell 300 of the soft-side cooler.

Additionally, in some embodiments, the bottom edge 622 of the inner lip 620 can be doubled over such that it abuts the inner surface of the inner liner 315. Accordingly, as shown in FIG. 6E, in some embodiments, the doubled-over bottom edge 612 of the outer lip 610 and the doubled-over bottom edge 622 of the inner lip 620 can also serve as the figurative bread that sandwiches together the outer shell 300 and the upper portion of the inner liner 315. As will be appreciated, configuring the components in such a manner provides a secure connection of the materials. Further, such a design provides clean edges, which gives an appealing presentation and prevents users from accidentally snagging exposed cooler materials when using the cooler.

While the present disclosure has been described in connection with a plurality of exemplary aspects, as illustrated in the various figures and discussed above, it is understood that other similar aspects can be used or modifications and additions can be made to the described aspects for performing the same function of the present disclosure without deviating therefrom. For example, in various aspects of the disclosure, methods and compositions were described according to aspects of the presently disclosed subject matter. In particular, aspects of the present disclosure have been described in relation to a soft-side cooler comprising closed-cell foam, but aspects of the disclosed technology can be used with soft-side coolers comprising open-cell foam. Additionally, other equivalent methods or composition to these described aspects are also contemplated by the teachings herein. Therefore, the present disclosure should not be limited to any single aspect, but rather construed in breadth and scope in accordance with the appended claims.

The invention claimed is:

1. A cooler comprising:

an outer shell;

an inner liner;

an insulating core disposed between the outer shell and the inner liner, the insulating core comprising a foam material;

a zipper mechanism having a slider and opposing stringers, each opposing stringer comprising (i) a row of teeth and (ii) a zipper tape;

an inner lip proximate a top of the cooler, the inner lip formed by:

stitching the outer shell to the inner liner to form an attachment;

folding the attachment inwards such that the attachment is disposed under the zipper tape; and stitching the zipper tape to the attachment, the attachment being disposed under the zipper tape; and a first strap and a second strap corresponding to a first side and a second side of the outer shell, each strap comprising a top end, a bottom end, and a middle portion disposed between the top end and the bottom end, a first end of each opposing stringer being attached to the first strap and a second end of each opposing stringer being attached to the second strap;

wherein the bottom end of the first strap and the bottom end of the second strap are disposed between the inner lip and the inner liner.

2. The cooler of claim 1, wherein the top end of the first strap attaches to the first end of each opposing stringer and the top end of the second strap attaches to the second end of each opposing stringer.

3. The cooler of claim 1, wherein the zipper tape comprises a flexible material.

4. The cooler of claim 1, wherein the foam material comprises at least one of soft-cell foam and closed-cell foam.

5. The cooler of claim 1, further comprising a first side-release buckle disposed on the first side of the outer shell and a second side-release buckle disposed on the second side of the outer shell, wherein the first and second side-release buckles are configured for securing the first and second straps to the first and second sides of the outer shell.

6. The cooler of claim 5, wherein the first strap and the second strap each further comprise a first strap buckle and a second strap buckle attached thereto on the top end of each strap, the first strap buckle and the second strap buckle configured to connect to the first side-release buckle and the second side-release buckle, respectively.

7. A cooler comprising:

an outer shell;

an inner liner;

an inner lip proximate the top of the cooler;

an insulating core disposed between the outer shell and the inner liner, the insulating core comprising a foam material;

a zipper mechanism having a slider and opposing stringers, each opposing stringer comprising: (i) a row of teeth and (ii) a zipper tape attached to the inner lip; and a first strap and a second strap corresponding to a first side and a second side of the outer shell, each strap comprising a top end, a bottom end, and a middle portion disposed between the top end and the bottom end, a first end of each opposing stringer being attached to the first strap and a second end of each opposing stringer being attached to the second strap;

wherein, for each of the first strap and the second strap, the bottom end is folded under the middle portion to form a fold, the bottom end being disposed between the inner lip and the inner liner such that the bottom end is sandwiched between the inner liner and the inner lip, and the inner lip is sandwiched between the fold.

8. The cooler of claim 7, wherein the inner lip is formed by:

stitching the outer shell to the inner liner to form an attachment;

folding the attachment inwards such that the attachment is disposed under the zipper tape; and stitching the zipper tape to the attachment, the attachment being disposed under the zipper tape.

9. The cooler of claim 7, wherein the top end of the first strap attaches to the first end of each opposing stringer and the top end of the second strap attaches to the second end of each opposing stringer.

10. The cooler of claim 7, wherein the zipper tape comprises a flexible material.

11. The cooler of claim 7, wherein the foam material comprises at least one of soft-cell foam and closed-cell foam.

12. The cooler of claim 7, further comprising a first side-release buckle disposed on the first side of the outer shell and a second side-release buckle disposed on the second side of the outer shell, wherein the first and second side-release buckles are configured for securing the first and second straps to the first and second sides of the outer shell.

13. The cooler of claim 12, wherein the first strap and the second strap each further comprise a first strap buckle and a second strap buckle attached thereto on the top end of each strap, the first strap buckle and the second strap buckle configured to connect to the first side-release buckle and the second side-release buckle, respectively.

14. A cooler comprising:

an outer shell;

an inner liner;

an insulating core disposed between the outer shell and the inner liner, the insulating core comprising a foam material;

a zipper mechanism having a slider and opposing stringers, each opposing stringer comprising: (i) a row of teeth and (ii) a zipper tape;

a first strap and a second strap corresponding to a first side and a second side of the outer shell, each strap comprising a top end, a bottom end, and a middle portion disposed between the top end and the bottom end, a first end of the stringer being attached to the top end of the first strap and a second end of the stringer being attached to the top end of the second strap; and a first side-release buckle disposed on the first side of the outer shell and a second side-release buckle disposed on the second side of the outer shell, wherein the first and second side-release buckles are configured for securing the first and second straps to the first and second sides of the outer shell.

15. The cooler of claim 14, further comprising an inner lip proximate the top of the cooler, the inner lip formed by:

stitching the outer shell to the inner liner to form an attachment;

folding the attachment inwards such that the attachment is disposed under the zipper tape; and stitching the zipper tape to the attachment, the attachment being disposed under the zipper tape.

16. The cooler of claim 15, wherein the bottom end of the first strap and the bottom end of the second strap are disposed between the inner lip and the inner liner.

17. The cooler of claim 15, wherein, for each of the first strap and the second strap, the bottom end is folded under the middle portion, the bottom end being disposed between the inner lip and the inner liner such that the bottom end is sandwiched between the inner liner and the inner lip, and the inner lip is sandwiched between the fold of the bottom end and the middle portion.

18. The cooler of claim 14, wherein the zipper tape comprises a flexible material.

19. The cooler of claim 14, wherein the foam material comprises at least one of soft-cell foam and closed-cell foam.

* * * * *